US010760185B2

(12) United States Patent
Tanaka et al.

(10) Patent No.: US 10,760,185 B2
(45) Date of Patent: Sep. 1, 2020

(54) ACRYLONITRILE-CONTAINING FIBER DYEABLE WITH DISPERSE DYES, METHOD FOR PRODUCING SAME, AND FIBER PRODUCT CONTAINING SAME

(71) Applicant: Kaneka Corporation, Osaka (JP)

(72) Inventors: Takeshi Tanaka, Hyogo (JP); Tomomichi Hashimoto, Hyogo (JP)

(73) Assignee: KANEKA CORPORATION, Osaka (JP)

( * ) Notice: Subject to any disclaimer, the term of this patent is extended or adjusted under 35 U.S.C. 154(b) by 373 days.

(21) Appl. No.: 15/729,059

(22) Filed: Oct. 10, 2017

(65) Prior Publication Data

US 2018/0038014 A1 Feb. 8, 2018

Related U.S. Application Data

(63) Continuation of application No. PCT/JP2016/060944, filed on Apr. 1, 2016.

(30) Foreign Application Priority Data

Apr. 10, 2015 (JP) ..... 2015-080733

(51) Int. Cl.

| | |
|---|---|
| ***D01F 6/18*** | (2006.01) |
| ***D06P 3/72*** | (2006.01) |
| ***D01F 6/54*** | (2006.01) |
| ***D02G 3/04*** | (2006.01) |
| ***D01F 6/38*** | (2006.01) |
| ***D01F 6/08*** | (2006.01) |
| ***D01F 6/50*** | (2006.01) |

(52) U.S. Cl.

CPC ..... *D01F 6/18* (2013.01); *D01F 6/08* (2013.01); *D01F 6/38* (2013.01); *D01F 6/50* (2013.01); *D01F 6/54* (2013.01); *D02G 3/04* (2013.01); *D02G 3/045* (2013.01); *D06P 3/72* (2013.01)

(58) Field of Classification Search

CPC ..... D01F 6/54; D01F 6/38; D01F 6/18; D01F 6/08; D01F 6/50; C08J 5/042; D02G 3/04; D02G 3/045; D02G 3/05; D06P 3/72; Y10T 428/2978; Y10T 428/2973

USPC ..... 428/357, 400, 359, 361, 364, 370, 374, 428/403, 394

See application file for complete search history.

(56) References Cited

U.S. PATENT DOCUMENTS 5,344,711 A * 9/1994 Kanzaki ..... D01D 5/247 264/41

FOREIGN PATENT DOCUMENTS

| | | | |
|---|---|---|---|
| JP | S53-002622 | A | 1/1978 |
| JP | S53-078322 | A | 7/1978 |
| JP | S57-210011 | A | 12/1982 |
| JP | S63-130103 | A | 6/1988 |
| JP | H5-148777 | A | 6/1993 |
| JP | H5-310455 | A | 11/1993 |
| JP | H6-287806 | A | 10/1994 |
| JP | H07-90722 | A | 4/1995 |
| JP | H08-158202 | A | 6/1996 |
| JP | H11-276400 | A | 10/1999 |
| JP | 2000-290832 | A | 10/2000 |

OTHER PUBLICATIONS

T Sugiura: "Introduction to Chemical Fiber Dyeing and Color Measuring", Corona Publishing Co., Ltd.; Sokosha Printing Co., Ltd.; Nov. 30, 1970, (6 pages).

International Search Report issued in International Application No. PCT/JP2016/060944; dated Jun. 21, 2016, (4 pages).

* cited by examiner

*Primary Examiner* — Camie S Thompson

(74) *Attorney, Agent, or Firm* — Osha Liang LLP

(57) ABSTRACT

An acrylonitrile-containing fiber includes 100 parts by mass of a polymer including at least 15 parts by mass of acrylonitrile; and 1.0 to 50 parts by mass of a water absorbent resin having a pure water absorption capacity (g/g) with respect to its own weight of at least 10 but less than 100, wherein the fiber is dyeable with a disperse dye.

14 Claims, No Drawings

ACRYLONITRILE-CONTAINING FIBER DYEABLE WITH DISPERSE DYES, METHOD FOR PRODUCING SAME, AND FIBER PRODUCT CONTAINING SAME

TECHNICAL FIELD

One or more embodiments of the present invention relate to acrylonitrile-containing fibers that contain a water absorbent resin and can be dyed with disperse dyes, a method for producing the same, and a fiber product containing the same.

BACKGROUND

Conventionally, acrylonitrile-containing fibers commonly have been dyed by a dyeing method using a cationic dye. However, when a cationic dye is used to dye acrylonitrile-containing fibers, a vivid hue can be obtained; however, cationic dyes generally have poor light fastness. Furthermore, in dyeing a fiber product composed of acrylonitrile-containing fibers and polyester-based fibers, a technique is used in which a cationic dye and a disperse dye are placed in the same bath and the acrylonitrile-containing fibers are dyed with the cationic dye while the polyester-based fibers are dyed with the disperse dye. However, when the polyester-based fibers are polyethylene terephthalate fibers (PET fibers), they are usually dyed at a high temperature of 130° C. under high pressure, and thus, in such dyeing conditions, the acrylonitrile-containing fibers that have a glass transition temperature of less than 130° C. are deteriorated in physical properties such as texture and fiber strength. On the other hand, when they are dyed at a temperature at which the physical properties of the acrylonitrile-containing fibers do not deteriorate, the PET fibers cannot be dyed in deep colors. Non-Patent Document 1 proposes carrier dyeing as a method for dyeing PET fibers at normal pressure and a temperature of less than 100° C. Furthermore, as a method for dyeing a fiber product composed of acrylonitrile-containing fibers and polyester-based fibers, a thermosol dyeing method is known in which a fiber product is immersed in a disperse dye solution to be dyed, and thereafter the dye that dyed the fiber product is heated at a temperature of about 190° C. to 220° C. to be fixed to the fibers.

In addition, as a method for dyeing a fiber product, Patent Document 1 proposes a method including applying a water absorbent resin to the surface of a fabric to dye the fiber product with a dye by an inkjet method. On the other hand, with respect to the water absorbent resin, it is known to exhibit various functions not only by being applied to the surface of a fabric but also by being added to fibers. For example, Patent Document 2 describes that a water absorbent resin is added to a polyolefin-based resin such as polypropylene and then this is extruded to obtain reinforcing fibers having good dispersibility in cement. Also with respect to the acrylonitrile-containing fibers, Patent Document 3 describes that a water absorbent resin is dispersed in an acrylonitrile-containing resin and then this is heat-moisture treated to obtain porous fibers.

PATENT DOCUMENTS

[Patent Document 1] JP5(1993)-148777A
[Patent Document 2] JP5(1993)-310455A
[Patent Document 3] JP2000-290832A

NON-PATENT DOCUMENTS

[Non-Patent Document 1] "Introduction to Chemical Fiber Dyeing And Color Measuring (GōSei Sen'i No Senshoku To Sokushoku)" (by Tomihei Sugiura, published by Corona Publishing Co., Ltd., pp. 60-64)

In the proposal in Non-Patent Document 1 described above, a substance of concern in terms of safety and environment such as odor and toxicity is used as a carrier and therefore currently this method is seldom used. Furthermore, with respect to the disperse dye dyeing of acrylonitrile-containing fiber products by the thermosol process, it is necessary to increase the dye concentration in order to dye acrylonitrile-containing fibers in a deep color, and the acrylonitrile-containing fibers dyed in a deep color by the thermosol process have poor washing fastness and are not practically preferable in terms of both cost and quality. In addition, the proposal of Patent Document 1 described above has poor rubbing fastness since the water absorbent resin applied to the surface is dyed with the dye. Moreover, Patent Documents 2 and 3 mentioned above that describe the addition of a water absorbent resin to fibers have no mention of dyeing. Furthermore, in a wet spinning method in which a spinning solution prepared by dissolving a resin in an organic solvent is discharged in an organic solvent-water mixture bath, which is a common method of spinning acrylonitrile-containing fibers, the use of a water absorbent resin that is insoluble to water and also insoluble to the organic solvent used in the spinning solution not only causes nozzle clogging but also results in a low fiber strength since the water absorbent resin expands to be phase-separated from the matrix resin and processability is poor since static electricity is generated.

SUMMARY

One or more embodiments of the present invention provide acrylonitrile-containing fibers dyeable with disperse dyes, the acrylonitrile-containing fibers containing a water absorbent resin and being dyeable in deep colors with disperse dyes, a method for producing the same, and a fiber product containing the same.

One or more embodiments of the present invention relate to acrylonitrile-containing fibers dyeable with disperse dyes, the fibers containing 1.0 to 50 parts by mass of a water absorbent resin having a pure water absorption capacity (g/g) with respect to its own weight of at least 10 but less than 100, with respect to 100 parts by mass of a polymer containing at least 15 parts by mass of acrylonitrile.

Furthermore, one or more embodiments of the present invention relate to a method for producing the above-mentioned acrylonitrile-containing fibers dyeable with disperse dyes, the method including spinning a spinning solution to obtain the acrylonitrile-containing fibers dyeable with disperse dyes, and the spinning solution being prepared by dissolving, in an organic solvent, 100 parts by mass of a polymer containing at least 15 parts by mass of acrylonitrile and 1.0 to 50 parts by mass of a water absorbent resin having a pure water absorption capacity (WO with respect to its own weight of at least 10 but less than 100.

One or more embodiments of the present invention also relate to a fiber product, the fiber product containing the above-mentioned acrylonitrile-containing fibers dyeable with disperse dyes.

One or more embodiments of the present invention can provide acrylonitrile-containing fibers dyeable with disperse dyes and fiber products containing the same, the acrylonitrile-containing fibers containing a water absorbent resin and being dyeable in deep colors with disperse dyes.

DETAILED DESCRIPTION OF THE EMBODIMENTS

The present inventors found that when 1.0 to 50 parts by mass of a water absorbent resin having a pure water absorption capacity (g/g) with respect to its own weight of at least 10 but less than 100 is contained with respect to 100 parts by mass of a polymer containing at least 15 parts by mass of acrylonitrile, acrylonitrile-containing fibers that have good spinnability and can be dyed in deep colors with disperse dyes can be obtained. The acrylonitrile-containing fibers according to one or more embodiments of the present invention may include an acrylonitrile-containing polymer containing at least 15 parts by mass of acrylonitrile with respect to 100 parts by mass of the polymer and a water absorbent resin having a pure water absorption capacity (g/g) with respect to its own weight of at least 10 but less than 100, the absorbent resin being contained in an amount of 1.0 to 50 parts by mass with respect to 100 parts by mass of the acrylonitrile-containing polymer.

In one or more embodiments of the present invention, the polymer may contain acrylonitrile in an amount of at least 15 parts by mass, or 30 to 70 parts by mass, with respect to 100 parts by mass of the polymer. Examples of the polymer containing at least 15 parts by mass of acrylonitrile include, but are not limited to, acrylonitrile homopolymers, copolymers of acrylonitrile-containing monomers and monomers containing no acrylonitrile, and polymer blends of acrylonitrile-containing polymers and polymers containing no acrylonitrile.

Specific examples of the acrylonitrile-containing polymer include, but are not limited to, polyacrylonitrile and a copolymer of acrylonitrile and methacrylonitrile. Examples of the copolymers of acrylonitrile-containing monomers and monomers containing no acrylonitrile include, but are not limited to, copolymers of acrylonitrile and copolymerizable vinyl-based monomers. Examples of the copolymerizable vinyl-based monomers include vinyl chloride, vinylidene chloride, vinyl bromide, vinylidene bromide, acrylic acid and an ester thereof; methacrylic acid and an ester thereof, acrylamide, methacrylamide, vinyl acetate, vinylsulfonic acid and a salt thereof, methacrylsulfonic acid and a salt thereof, as well as styrenesulfonic acid and a salt thereof, and one or more of them can be used.

In one or more embodiments of the present invention, the acrylonitrile-containing polymer may be, for example, a polymer containing, with respect to 100 parts by mass of the polymer, 30 to 70 parts by mass of acrylonitrile, 30 to 70 parts by mass of halogen-containing vinylidene monomer and/or halogen-containing vinyl monomer, and 0 to 10 parts by mass of vinyl monomer copolymerizable therewith. That is, a polymer may be obtained by polymerizing a composition having a total amount of 100 parts by mass composed of 30 to 70 parts by mass of acrylonitrile, 30 to 70 parts by mass of halogen-containing vinylidene monomer and/or halogen-containing vinyl monomer, and 0 to 10 parts by mass of vinyl monomer copolymerizable therewith. When the content of the acrylonitrile is 30 to 70 parts by mass, heat resistance required for fiberization is obtained, and when the content of the halogen-containing vinylidene and/or the halogen-containing vinyl is 30 to 70 parts by mass, flame retardancy can also be obtained. The lower limit of the content of the acrylonitrile may be at least 35 parts by mass, or at least 45 parts by mass. The upper limit of the content of the acrylonitrile may be 65 parts by mass or less, or 57 parts by mass or less. Within the range described above, heat resistance required for fibers used for clothing, etc. may be obtained. In order to allow the acrylonitrile-containing fibers to exhibit high flame retardancy, it may be possible to use particularly halogen-containing vinyl and/or halogen-containing vinylidene monomer as the copolymerizable vinyl-based monomers. The homopolymers and/or copolymers can be obtained by known polymerization methods. Examples of the polymerization type include, but are not limited to, bulk polymerization, suspension polymerization, emulsion polymerization, and solution polymerization. Examples of the polymerization mode include, but are not limited to, continuous mode, batch mode, and semibatch mode. Among these, from the industrial viewpoint, the emulsion polymerization, suspension polymerization, and solution polymerization may be used as the polymerization type, and the continuous mode and semibatch mode may be used as the polymerization mode.

The water absorbent resin used in one or more embodiments of the present invention is not particularly limited as long as it is a water absorbent resin having a pure water absorption capacity (gig) with respect to its own weight of at least 10 but less than 100. Examples of the water absorbent resin to be used herein include polyethylene oxide, polypropylene oxide, a copolymer of ethylene oxide and propylene oxide, a reaction product of polyalkylene oxide such as polybutylene oxide and an isocyanate compound, crosslinked polyalkylene oxide obtained by reacting polyalkylene oxide with polyisocyanate, or modified polyalkylene oxide obtained by irradiating the reaction product of polyalkylene oxide and an isocyanate compound or the crosslinked polyalkylene oxide with an electron beam. Particularly, the crosslinked polyethylene oxide obtained by reacting a polyethylene oxide having a mass average molecular weight (also referred to as "weight average molecular weight") of 1,000 to 6,000,000 with polyisocyanate such as tolylene diisocyanate or diphenylmethane diisocyanate may be used since the crosslinked polyethylene oxide is dissolved in a hydrophilic organic solvent such as N,N-dimethylformamide, N,N-dimethylsulfoxide, N,N-dimethylacetamide, or acetone that is generally used in wet spinning of acrylic fibers or acrylic-based fibers and has high compatibility with an acrylonitrile-containing resin. Such a modified polyalkylene oxide to be used herein can be one that is commercially available such as "AQUA CALK" (trade name) of Sumitomo Seika Chemicals Co., Ltd. When the mass average molecular weight is less than 1000, the water-absorbent resin tends to be eluted into the spinning bath. A pure water absorption capacity (g/g) with respect to its own weight of at least 10 allows a disperse dye to dye easily at the time of dyeing, which is advantageous. When the putt water absorption capacity (g/g) with respect to its own weight is 100 or more, a large amount of water is contained in the fibers in the water-washing step of the spinning process and this results in not only low drying efficiency, but also low single fiber strength of the resultant fibers. From the viewpoints of enhancing the deep color dyeability obtained using a disperse dye and also improving, for example, spinnability and quality such as fiber strength, the water absorbent resin may have a pure water absorption capacity (gig) with respect to its own weight of 50 or less.

The amount of the water absorbent resin to be added with respect to 100 parts by mass of the polymer containing at least 15 parts by mass of acrylonitrile may be at least 1.0 part by mass, or at least 3.0 parts by mass, or at least 5.0 parts by mass, and the upper limit thereof may be 50 parts by mass or less, or 30 parts by mass or less, or 20 parts by mass or less. When the content of the water absorbent resin is less than 1.0 part by mass, sufficient coloring may not be obtained at the time of dyeing with the disperse dye. When it exceeds 50 parts by mass, clogging of the filter cloth and the nozzle as well as elution of the water absorbent resin into the bath may occur in the fiber production process and furthermore, sufficient fiber properties (strength and elongation) may not be obtained.

According to one or more embodiments of the present invention, the water absorbent resin may be dispersed, in the fibers, with an average particle diameter of less than 500 nm, from the viewpoints of the disperse-dyeing coloring properties, fiber production processability in terms of nozzle clogging and elution into the bath, fiber properties such as strength and elongation, washing fastness, and rubbing fastness. The average particle diameter of the water absorbent resin dispersed in the fibers (hereinafter abbreviated as "dispersion average particle diameter") can be measured by observation using a transmission electron microscope (TEM). Specifically, the particle diameters of 100 particles are measured using an image analysis software WinROOF (Ver. 5.04) in an arbitrary field of view of a photograph (10000 times) of the cross-section perpendicular to the fiber axis by a transmission electron microscope, and then the average value thereof is calculated. When the average particle diameter is set to be less than 300 nm, the above-mentioned capabilities are improved. In one or more embodiments of the present invention, the average particle diameter may be less than 100 nm, or less than 50 nm.

The water absorbent resin may be a thermoplastic resin having a softening temperature of 100° C. or less from the viewpoint that it can be dyed under normal pressure. When a thermoplastic water absorbent resin having a softening temperature of 100° C. or less is added to acrylonitrile-containing fibers, for example, the thermoplastic water absorbent resin in the fibers softens under the general conditions for dyeing acrylonitrile-containing fibers, which makes the disperse dye to be exhausted easily.

The acrylonitrile-containing fibers as described herein are produced, for example, by a known production method such as a wet spinning method, a dry spinning method, or a semi-dry semi-wet spinning method, using a spinning solution prepared by adding 1.0 to 50 parts by mass of a water absorbent resin to 100 parts by mass of a polymer containing at least 15 parts by mass of acrylonitrile and then dissolving them in an organic solvent, with the water absorbent resin having a pure water absorption capacity (gig) with respect to its own weight of at least 10. For example, in the wet spinning method, a spinning solution is extruded into a coagulation bath through a nozzle to be coagulated and subsequently washed with water, dried, drawn, heat-treated, crimped if necessary, and then cut to obtain a product. The spinning solution contains the water absorbent resin added to and dissolved in a resin solution containing the acrylonitrile-containing polymer dissolved in a hydrophilic organic solvent such as N,N-dimethylformamide, N,N-dimethylacetamide, acetone, or N,N-dimethylsulfoxide. The hydrophilic organic solvent may be any one as long as it dissolves the acrylonitrile-containing polymer and the water absorbent resin, and it may be one selected from the group consisting of N,N-dimethylformamide, N,N-dimethylacetamide, N,N-dimethylsulfoxide, and acetone since they can be handled industrially. In one or more embodiments of the present invention, the hydrophilic organic solvent may be selected from the group consisting of N,N-dimethylformamide, N,N-dimethylacetamide, and N,N-dimethylsulfoxide since it may improve the disperse-dyeing coloring properties.

The acrylonitrile-containing fibers as described herein may be short fibers or long fibers, and they can be suitably selected depending on the method of use. For example, in order to combine them with other natural fibers, regenerated fibers, semisynthetic fibers, and/or synthetic fibers other than the acrylonitrile-containing fibers to be processed, they may be those approximate to the fibers to be combined. The cut length is suitably selected depending on the application of the fiber product. Examples of such fibers include short cut fibers (fiber length: 0.1 to 5 mm), short fibers (fiber length: 38 to 128 mm), and long fibers (filaments) not cut at all. The fineness is suitably selected depending on other natural fibers, regenerated fibers, semi-synthetic fibers, and/or synthetic fibers other than acrylonitrile-containing fibers, which are used for the application of the fiber product to be used, and it may be 1 to 80 dtex. However, when the acryloniftile-containing fibers are combined with other fibers, they may have a fineness equal to that of other fibers or may be thinner or thicker.

In one or more embodiments of the present invention, the acrylonitrile-containing fibers may contain other additives such as an antistatic agent, a thermal coloration inhibitor, a light resistance improver, a whiteness improver, a matting inhibitor, a coloring agent, and a flame retardant, if necessary.

The acrylonitrile-containing fibers as described herein may be used alone or in combination with, for example, natural fibers, regenerated fibers, semisynthetic fibers, or synthetic fibers other than the aforementioned acrylonitrile-containing fibers. Examples of the method for combining these include cotton blending, mixed spinning, and fiber blending, and examples of the specific form of the combination include nonwoven fabric, woven fabric, knit fabric, knitted lace, and a fiber bundle.

Examples of the woven fabric include plain weave, twill weave, satin weave, variegated plain weave, variegated twill weave, variegated satin weave, fancy weave, brocade, single texture, double texture, multiple texture, warp pile weave, weft pile weave, and interweave. The plain weave, satin weave, and brocade are excellent in, for example, texture and strength as goods.

Examples of the knit fabric include circular knitted fabric, weft knitted fabric, warp knitted fabric, and pile knitted fabric, and there are plain stitch, plain knit, rib-knit, smooth knit (double knit), rib stitch, purl stitch, Denbigh texture, cord texture, atlas texture, chain texture, insertion texture, etc. The plain knit and the rib-knit are excellent in texture as goods.

Examples of the fiber bundle include hair bundles containing at least two types of long fibers mixed uniformly or ununiformly, with the long fibers having been cut into a uniform length.

The fiber product according to one or more embodiments of the present invention may be one consisting of the acrylonitrile-containing fibers alone or a product containing the acrylonitrile-containing fibers and at least one type of fibers selected from the group consisting of natural fibers, regenerated fibers, semisynthetic fibers, and synthetic fibers other than the acrylonitrile-containing fibers. In the fiber product, the lower limit of the content of the at least one type of fibers selected from the group consisting of natural fibers, regenerated fibers, semisynthetic fibers, and synthetic fibers other than the acrylonitrile-containing fibers may be 10% by mass or more, or 30% by mass or more, and the upper limit thereof may be 90% by mass or less, or 70% by mass or less. The fiber product may contain acrylonitrile-containing fibers in an amount of 30% by mass or more and may contain them in an amount of 70% by mass or less.

Examples of the natural fibers that can be used include cotton, kapok fibers, linen, hemp fibers, ramie fibers, jute fibers, Manila hemp fibers, kenaf fibers, wool fibers, mohair fibers, cashmere fibers, camel fibers, alpaca fibers, angora fibers, and silk fibers.

Examples of the regenerated fibers that can be used include regenerated cellulose fibers (rayon, polynosic, "Cupra" (trade name) manufactured by Asahi Kasei Corporation, "Tencel" (trade name) and "Lenzing Modal" (trade name) manufactured by Lenzing AG), regenerated collagen fibers, and regenerated protein fibers.

Examples of the synthetic fibers other than the acrylonitrile-containing fibers that can be used include polyester fibers, polyamide fibers, polylactic acid fibers, acrylic fibers, polyolefin fibers, polyvinyl alcohol fibers, polyvinyl chloride fibers, polyvinylidene chloride fibers ("Saran" (trade name) manufactured by Asahi Kasei Fibers Corporation), polychlal fibers, polyethylene fibers ("Dyneema" (trade name) manufactured by Toyobo Co., Ltd.), polyurethane fibers, polyoxymethylene fibers, polytetrafluoroethylene fibers, aram id fibers ("Kevlar" (trade name) and "Nomex" (trade name) manufactured by DuPont as well as "Technora" (trade name), "Twaron" (trade name), and "Conex" (trade name) manufactured by Teijin Limited), benzoate fibers, polyphenylene sulfide fibers ("Procon" (trade name) manufactured by Toyobo Co., Ltd.), polyether ether ketone fibers, polybenzazole fibers, polyimide fibers ("P84" (trade name) manufactured by Toyobo Co., Ltd.), and polyamide-imide fibers ("Kermel" (trade name) manufactured by Kennel).

Furthermore, examples of the regenerated fibers include special regenerated cellulose fibers (rayon fibers containing water glass: "Visil" (trade name) manufactured by Sateri, "FR Corona" (trade name) manufactured by Daiwabo Co., Ltd.), post-processed flame-retardant cellulose fibers coated with a flame retardant, and untreated flame-retardant rayon fibers ("Lenzing FR" (trade name) manufactured by Lenzing AG). Moreover, examples of the synthetic fibers other than the acrylonitrile-containing fibers include flame-retardant polyester ("Heim" (trade name) manufactured by Toyobo Co., Ltd., "Trevira CS" (trade name) manufactured by Trevira GmbH), polyethylene naphthalate fibers ("Teonex" (trade name) manufactured by Teijin Limited), melamine fibers ("Basofil" (trade name) manufactured by Basofil Fibers, LLC), acrylate fibers ("Moiscare" (trade name) manufactured by Toyobo Co., Ltd.), and polybenzoxide fibers ("Zylon" (trade name) manufactured by Toyobo Co., Ltd.). Other examples that can be used include acryl oxide fibers, carbon fibers, glass fibers, and activated carbon fibers.

In one or more embodiments of the present invention, the fiber product can suitably contain cellulosic fibers and/or polyester-based fibers. The cellulosic fibers used in one or more embodiments of the present invention may be cellulosic fibers belonging to any of natural fibers, regenerated fibers, semisynthetic fibers, or synthetic fibers other than the acrylonitrile-containing fibers. Among these, the cellulosic fibers may be at least one type of cellulosic fibers selected from the group consisting of cotton, linen, rayon, polynosic, cupra, and cellulose acetate fibers, particularly may be cotton and/or rayon in terms of hygroscopicity and wear comfort. In terms of wear comfort, the fiber product may contain 30 to 70% by mass of cellulosic fibers. The polyester-based fibers used in one or more embodiments of the present invention may be at least one type of polyester-based fibers selected from the group consisting of polyethylene terephthalate fibers (PET fibers), polybutylene terephthalate fibers (PBT), polyethylene naphthalate fibers (PEN), and polytriethylene terephthalate fibers (PTT).

Examples of the fiber product according to one or more embodiments of the present invention include the following:

(1) Clothing and Daily Necessities Materials

Clothes (including outerwear, underwear, sweaters, vests, trousers, etc.), gloves, socks, mufflers, hats, bedding, pillows, cushions, stuffed toys, etc.

(2) Special Clothes

Protective clothing, fireman uniforms, working clothes, winter clothes, etc.

(3) Interior Materials

Chair upholsteries, curtains, wallpapers, carpets, etc.

(4) Hair Items

Braids, weaves, wigs, etc.

Examples of the method of dyeing the acrylonitrile-containing fibers of one or more embodiments of the present invention using a disperse dye include a method of dyeing in the fiber state (cotton dyeing in the case of short fibers) and a method of dyeing in the yarn or fabric state, but the method is not particularly limited. The dyeing technique may be a dip dyeing technique in which dipping is carried out in a dyeing solution containing a dye dissolved or dispersed therein or may be a printing technique in which a sizing agent is mixed with a dyeing solution and the mixture is used for printing directly on a product such as a fabric. Examples of the method of dyeing in the fabric state include a discontinuous process, a semi-continuous process, and a continuous process. Examples of the discontinuous process include dyeing using a common wince dyeing machine, dyeing using a beam dyeing machine, and dyeing using a jet dyeing machine. Examples of the continuous process include pad-steam dyeing and dyeing using a thermosol dyeing machine or a continuous high pressure dyeing machine. In addition, a method of fixing a disperse dye by an ink jet process may be used.

EXAMPLES

Hereinafter, one or more embodiments of the present invention are described with reference to examples, but the present invention is not limited to these examples. In the following examples, "%" denotes "% by mass".

Example 1: Acrylonitrile-Containing Fiber Production Example 1

A copolymer (an acrylonitrile-containing polymer) obtained by polymerizing a composition composed of 46 parts by mass of acrylonitrile, 52 parts by mass of vinyl chloride, and 2 parts by mass of sodium p-styrenesulfonate was dissolved in N,N-dimethylsulfoxide in such a manner that a resin concentration of 27% by mass was obtained, and thereby a resin solution was obtained. With respect to 100 parts by mass of the resin (the acrylonitrile-containing polymer) contained in the resin solution thus obtained, 10 parts by mass of a water absorbent resin (modified polyethylene oxide, "AQUA CALK TWB" manufactured by Sumitomo Seika Chemicals Co., Ltd., softening temperature 60° C., mass average molecular weight 110,000) was added and dissolved therein, and thereby a spinning solution was obtained. This spinning solution was extruded into a 60% by mass N,N-dimethylsulfoxide aqueous solution using a nozzle having a nozzle hole diameter of 0.08 mm and 2,000 holes and then washed with water while being drawn. Thus, a washed yarn was obtained. The washed yarn was dried with uniformly hot air at 140° C. and further dried with a heat roll at 160° C. Thereafter, it was drawn to be doubled in its length at 130° C. and then heat-treated at 150° C. Thus, acrylonitrile-containing fibers having a fineness of 2 dtex were obtained. To the acrylonitrile-containing fibers thus obtained, a spinning finish oil (manufactured by Takemoto Oil & Fat Co., Ltd.) was applied and then they were crimped and cut to a length of 38 mm.

Example 2: Acrylonitrile-Containing Fiber Production Example 2

A copolymer (an acrylonitrile-containing polymer) obtained by polymerizing a composition composed of 51 parts by mass of acrylonitrile, 48 parts by mass of vinylidene chloride, and 1 part by mass of sodium p-styrenesulfonate was dissolved in N,N-dimethylsulfoxide in such a manner that a resin concentration of 27% by mass was obtained, and thereby a resin solution was obtained. With respect to 100 parts by mass of the resin (the acrylonitrile-containing polymer) contained in the resin solution thus obtained, 10 parts by mass of a water absorbent resin (modified polyethylene oxide, "AQUA CALK TWB" manufactured by Sumitomo Seika Chemicals Co., Ltd., softening temperature 60° C., weight average molecular weight 110,000) was added and dissolved therein, and thereby a spinning solution was obtained. This spinning solution was extruded into a 60% by mass N,N-dimethylsulfoxide aqueous solution using a nozzle having a nozzle hole diameter of 0.08 mm and 2,000 holes and then washed with water while being drawn. Thus, a washed yarn was obtained. The washed yarn was dried with uniformly hot air at 140° C. and further dried with a heat roll at 160° C. Thereafter, it was drawn to be doubled in its length at 130° C. and then heat-treated at 150° C. Thus, acrylonitrile-containing fibers having a fineness of 2 dtex were obtained. To the acrylonitrile-containing fibers thus obtained, a spinning finish oil (manufactured by Takemoto Oil & Fat Co., Ltd.) was applied and then they were crimped and cut to a length of 38 mm.

Example 3: Acrylonitrile-Containing Fiber Production Example 3

A copolymer (an acrylonitrile-containing polymer) obtained by polymerizing a composition composed of 51 parts by mass of acrylonitrile, 48 parts by mass of vinylidene chloride, and 1 part by mass of sodium p-styrenesulfonate was dissolved in acetone in such a manner that a resin concentration of 28% by mass was obtained, and thereby a resin solution was obtained. With respect to 100 parts by mass of the resin (the acrylonitrile-containing polymer) contained in the resin solution thus obtained, 10 parts by mass of a water absorbent resin (modified polyethylene oxide, "AQUA CALK TWB" manufactured by Sumitomo Seika Chemicals Co., Ltd, softening temperature 60° C., weight average molecular weight 110,000) was added and dissolved therein, and thereby a spinning solution was obtained. This spinning solution was extruded into a 38% by mass acetone aqueous solution using a nozzle having a nozzle hole diameter of 0.08 mm and 2,000 holes and then washed with water while being drawn. Thus, a washed yarn was obtained. The washed yarn was dried with uniformly hot air at 140° C., drawn to be doubled in its length at 140° C., and then heat-treated at 170° C. Thus, acrylonitrile-containing fibers having a fineness of 2 dtex were obtained. To the acrylonitrile-containing fibers thus obtained, a spinning finish oil (manufactured by Takemoto Oil & Fat Co., Ltd.) was applied and then they were crimped and cut to a length of 38 mm.

Comparative Example 1: Acrylonitrile-Containing Fiber Production Example 4

A copolymer (an acrylonitrile-containing polymer) obtained by polymerizing a composition composed of 46 parts by mass of acrylonitrile, 52 parts by mass of vinyl chloride, and 2 parts by mass of sodium p-styrenesulfonate was dissolved in N,N-dimethylsulfoxide in such a manner that a resin concentration of 27% by mass was obtained, and thereby a resin solution was obtained. With respect to 100 palls by mass of the resin (the acrylonitrile-containing polymer) contained in the resin solution thus obtained, 10 parts by mass of a water absorbent resin (acrylic acid/sodium acrylate copolymer, cross-linked, "AQUALIC CA_W101" manufactured by Nippon Shokubai Co., Ltd.) was added and dissolved therein, and thereby a spinning solution was obtained. This spinning solution was extruded into a 60% N,N-dimethylsulfoxide aqueous solution using a nozzle having a nozzle hole diameter of 0.30 mm and 100 holes and then washed with water while being drawn. However, many troubles such as yarn breakage and nozzle clogging occurred and therefore acrylonitrile-containing fibers were not able to be produced.

Comparative Example 2: Acrylonitrile-Containing Fiber Production Example 5

Acrylonitrile-containing fibers were produced by the same method as in Production Example 1 except that the water absorbent resin was not added.

Comparative Example 3: Acrylonitrile-Containing Fiber Production Example 6

Acrylonitrile-containing fibers were produced by the same method as in Production Example 2 except that the water absorbent resin was not added.

Experiment Example 1>: Method for Evaluating Water Absorption Capacity of Water Absorbent Resin 1 g of the water absorbent resin used in the above-mentioned production example was placed in a container containing 100 g of pure water, which then was stirred continuously at 40° C. for one hour. Thereafter, suction filtration was carried out for three minutes using an aspirator set with a filter paper, and the mass (A) of the water absorbent resin on the filter paper was measured. The pure water absorption capacity with respect to its own weight was calculated from the following equation.

$$\text{Pure water absorption capacity (g/g) with respect to its own weight} = (A-1)/1$$

Experiment Example 2>: Spinnability Evaluation Method

When acrylonitrile-containing fibers were produced by the production method of each production example described above, the spinnability was evaluated as follows based on whether or not troubles such as yarn breakage and nozzle clogging occurred.

Good Spinnability: No trouble occurred.

Poor Spinnability: Trouble occurred.

Experiment Example 3>: Method for Evaluating Disperse Dye Dyeability of Acrylonitrile-Containing Fibers 2.5 g of the acrylonitrile-containing fibers produced by the production method of each production example described above were placed in a container in which 0.063 g of navy disperse dye (Terasil Navy Blue SGL, manufactured by CIBA-GEIGY) was dispersed in 50 g of water. Dyeing was carried out at 98° C. for one hour while the container was oscillated. Thereafter, the fibers were taken out from the container, washed for ten minutes with running water, and then dried at 60° C. for 12 hours. Thus, the fibers dyed with the disperse dye was obtained. For the dyeability evaluation, a spectrophotometer (CM-2600d, manufactured by Konica Minolta) was used to carry out measurement under measurement conditions, viewing angle 2° and illuminant D65, in a measurement environment with a temperature of 25° C., and then the evaluation was conducted based on the following criteria according to JIS Z 8102. When being evaluated as A or B, they were judged to be dyeable with the disperse dye, and when being evaluated as C, they were judged to be not dyeable with the disperse dye.

A: Within the range of the three attributes of a typical color corresponding to navy blue (deep blue) according to JIS Z 8102 (Basic Color (H)=4 PB to less than 9 PB and Lightness (V)=1 to 3.2, and Chroma (C)=3.5 to 7)

B: Within the range of the three attributes of the color according to JIS Z 8102 (Basic Color (H)=4 PB to less than 9 PB, and Lightness (V)=1 to 3.5, and Chroma (C)=3.5 to 7)

C: At least one attribute deviating from the above ranges

Based on the results of Experimental Examples 2 and 3 described above, an overall evaluation was carried out according to the following criteria.

Pass: Good spinnability and dyeable with the disperse dye

Fail: Poor spinnability and/or not dyeable with the disperse dye

With respect to the acrylonitrile-containing fibers obtained in Examples 1 to 3 and Comparative Examples 1 to 3, spinnability and disperse dye dyeability were evaluated based on Experiment Examples 2 and 3 described above. The results are shown in Table 1 below.

TABLE 1

| | Water absorption capacity of water absorbent resin with respect to its own weight (g/g) | Spin-nability | Disperse Dye Dyeability | Overall Evaluation |
|---|---|---|---|---|
| Example 1 | 12.5 | Good | Judgment = A (H/V/C = 5.6 PB/2.44/5.54) | Pass |
| Example 2 | 12.5 | Good | Judgment = A (H/V/C = 5.6 PB/2.52/5.51) | Pass |
| Example 3 | 12.5 | Good | Judgment = B (H/V/C = 4.6 PB/3.48/5.53) | Pass |
| C. Example 1 | 240 | Poor | — | Fail |
| C. Example 2 | — | Good | Judgment = C (H/V/C = 4.4 PB/4.64/5.29) | Fail |
| C. Example 3 | — | Good | Judgment = C (H/V/C = 4.4 PB/4.89/5.26) | Fail |

In Examples 1 to 3, the water absorbent resin used therein had a water absorption capacity with respect to its own weight of 12.5 (g/g). In the spinnability evaluation of Examples 1 and 2, since it was possible to produce acrylonitrile-containing fibers without troubles such as yarn breakage and nozzle clogging, they were judged to have good spinnability. Furthermore, in the evaluation of the disperse dye dyeability of the acrylonitrile-containing fibers, a very strong deep navy color was obtained and therefore they were judged as A. Thus, the overall evaluation was determined as "Pass". In the spinnability evaluation of Example 3, since it was possible to produce acrylonitrile-containing fibers without troubles such as yarn breakage and nozzle clogging, they were judged to have good spinnability. Furthermore, in the evaluation of the disperse dye dyeability of the acrylonitrile-containing fibers, a deep navy color was obtained and therefore they were judged as B. Thus, the overall evaluation was determined as "Pass".

In Comparative Example 1, the water absorbent resin used therein had a water absorption capacity of 240 (g/g). In the spinnability evaluation, since there were many troubles such as yarn breakage and nozzle clogging, it was not possible to produce acrylonitrile-containing fibers and therefore the spinnability was judged as poor.

In the spinnability evaluations of Comparative Examples 2 to 3 in which no water absorbent resin was used, since it was possible to produce acrylonitrile-containing fibers without troubles such as yarn breakage and nozzle clogging, they were judged to have good spinnability. However, in the evaluation of the disperse dye dyeability, a deep navy color was not obtained and therefore they were judged as C. Thus, the overall evaluation was determined as "Fail".

Although the disclosure has been described with respect to only a limited number of embodiments, those skilled in the art, having benefit of this disclosure, will appreciate that various other embodiments may be devised without departing from the scope of the present invention. Accordingly, the scope of the present invention should be limited only by the attached claims.

What is claimed is:

1. An acrylonitrile-containing fiber, comprising:

100 parts by mass of a polymer comprising at least 15 parts by mass of acrylonitrile; and 1.0 to 50 parts by mass of a water absorbent resin having a pure water absorption capacity (g/g) with respect to its own weight of at least 10 but less than 100, wherein the polymer comprises, with respect to 100 parts by mass of the polymer:

30 to 70 parts by mass of the acrylonitrile;

30 to 70 parts by mass of halogen-containing vinylidene monomer and/or halogen-containing vinyl monomer; and 0 to 10 parts by mass of vinyl monomer copolymerizable therewith, wherein the fiber is dyeable with a disperse dye, and wherein the water absorbent resin comprises a modified polyalkylene oxide.

2. The acrylonitrile-containing fiber according to claim 1, wherein the water absorbent resin comprises crosslinked polyethylene oxide composed of polyethylene oxide and polyisocyanate.

3. A method for producing an acrylonitrile-containing fiber, the method comprising:

preparing a spinning solution by dissolving, in an organic solvent, 100 parts by mass of a polymer comprising at least 15 parts by mass of acrylonitrile and 1.0 to 50 parts by mass of a water absorbent resin having a pure water absorption capacity (g/g) with respect to its own weight of at least 10 but less than 100; and spinning the spinning solution to obtain an acrylonitrile-containing fiber, wherein the acrylonitrile-containing fiber is dyeable with a disperse dye, wherein the polymer comprises, with respect to 100 parts by mass of the polymer:

30 to 70 parts by mass of the acrylonitrile;

30 to 70 parts by mass of halogen-containing vinylidene monomer and/or halogen-containing vinyl monomer; and 0 to 10 parts by mass of vinyl monomer copolymerizable therewith, and wherein the water absorbent resin comprises a modified polyalkylene oxide.

4. The method for producing an acrylonitrile-containing fiber according to claim 3, wherein the water absorbent resin comprises crosslinked polyethylene oxide composed of polyethylene oxide and polyisocyanate.

5. The method for producing an acrylonitrile-containing fiber according to claim 3, wherein the organic solvent is one selected from the group consisting of N,N-dimethylformamide, N,N-dimethylacetamide, N,N-dimethylsulfoxide, and acetone.

6. The method for producing an acrylonitrile-containing fiber according to claim 5, wherein the organic solvent is one selected from the group consisting of N,N-dimethylformamide, N,N-dimethylacetamide, and N,N-dimethylsulfoxide.

7. A fiber product comprising an acrylonitrile-containing fiber, wherein the acrylonitrile-containing fiber comprises:

100 parts by mass of a polymer comprising at least 15 parts by mass of acrylonitrile; and 1.0 to 50 parts by mass of a water absorbent resin having a pure water absorption capacity (g/g) with respect to its own weight of at least 10 but less than 100, wherein the acrylonitrile-containing fiber is dyeable with a disperse dye, wherein the polymer comprises, with respect to 100 parts by mass of the polymer:

30 to 70 parts by mass of the acrylonitrile;

30 to 70 parts by mass of halogen-containing vinylidene monomer and/or halogen-containing vinyl monomer; and 0 to 10 parts by mass of vinyl monomer copolymerizable therewith, and wherein the water absorbent resin comprises a modified polyalkylene oxide.

8. The fiber product according to claim 7, wherein the water absorbent resin comprises crosslinked polyethylene oxide composed of polyethylene oxide and polyisocyanate.

9. The fiber product according to claim 7, wherein the fiber product comprises:

at least 10% by mass of the acrylonitrile-containing fiber; and

90% by mass or less of one or more fibers selected from the group consisting of a natural fiber, a regenerated fiber, a semisynthetic fiber, and a synthetic fiber other than the acrylonitrile-containing fiber.

10. The fiber product according to claim 9, wherein the fiber product comprises 30 to 70% by mass of the at least one type of fiber.

11. The fiber product according to claim 7, wherein the fiber product further comprises a cellulosic fiber.

12. The fiber product according to claim 11, wherein the cellulosic fiber is one or more fibers selected from the group consisting of cotton, linen, rayon, polynosic, cupra, and cellulose acetate fibers.

13. The fiber product according to claim 7, wherein the fiber product further comprises a polyester-based fiber.

14. The fiber product according to claim 7, wherein the acrylonitrile-containing fiber is dyed with a disperse dye.

* * * * *